US006864854B2

(12) United States Patent
Dai et al.

(10) Patent No.: US 6,864,854 B2
(45) Date of Patent: Mar. 8, 2005

(54) MULTI-BAND ANTENNA

(75) Inventors: Hsin Kuo Dai, Tu-Chen (TW); Hsiang-Hui Shen, Tu-chen (TW); Kun Te Cheng, Tu-Chen (TW); Lung-Sheng Tai, Tu-chen (TW); Hsien Chu Lin, Tu-Chen (TW)

(73) Assignee: Hon Hai Precision Ind. Co., LTD, Taipei Hsien (TW)

( * ) Notice: Subject to any disclaimer, the term of this patent is extended or adjusted under 35 U.S.C. 154(b) by 18 days.

(21) Appl. No.: 10/255,308

(22) Filed: Sep. 25, 2002

(65) Prior Publication Data

US 2004/0012528 A1 Jan. 22, 2004

(30) Foreign Application Priority Data

Jul. 18, 2002 (TW) ..... 91210916 U

(51) Int. Cl.[7] ..... H01Q 1/24; H01Q 1/36
(52) U.S. Cl. ..... 343/846; 343/702; 343/830
(58) Field of Search ..... 343/702, 804, 343/829, 830, 846, 848, 700 MS

(56) References Cited

U.S. PATENT DOCUMENTS 4,968,984 A * 11/1990 Katoh et al. ..... 343/713
6,344,823 B1 * 2/2002 Deng ..... 343/700 MS

FOREIGN PATENT DOCUMENTS

CN 1230037 A 2/1999
CN 2483918 Y 3/2002

* cited by examiner

*Primary Examiner*—Michael C. Wimer
(74) *Attorney, Agent, or Firm*—Wei Te Chung

(57) ABSTRACT

A multi-band antenna includes a first pole (2) and a second pole (3) connecting with the first pole. The first and second poles are both made of metal sheets. The first pole is rectangular in shape. The second pole includes a first section (31), a second section (32) and a third section (33). The second and third sections connect to the first section. The first, second and third sections integrally form a fork-shaped structure and each section has a different length. The first, second and third sections each radiate at a different frequency. A feeder device (5) includes a coaxial cable which electrically connects with the first pole and the second pole for feeding the antenna.

16 Claims, 7 Drawing Sheets

Scale:5dBi/div
Operating Frequencies Shown
Vertically Polarized

Scale:5dBi/div
Operating Frequencies Shown
Horizontally Polarized

Antenna Gain Over-All Performance:Mock up Sample

| Frequency / Avg.Gain | 2.40GHz | 2.45GHz | 2.50GHz | 5.15GHz | 5.25GHz | 5.35GHz | 5.45GHz | 5.60GHz | 5.75GHz |
|---|---|---|---|---|---|---|---|---|---|
| Vertical Polarization | -11.64 | -9.45 | -9.13 | -7.15 | -7.26 | -7.89 | -8.37 | -10.55 | -12.13 |
| Horizontal Polarization | -5.55 | -4.58 | -4.94 | -3.27 | -3.85 | -3.93 | -4.57 | -5.39 | -5.77 |
| Over all Average | -4.60 | -3.35 | -3.54 | -1.78 | -2.22 | -2.47 | -3.05 | -4.23 | -4.86 |

FIG. 11

MULTI-BAND ANTENNA

BACKGROUND OF THE INVENTION

1. Field of the Invention

The present invention relates to multi-band antennas, and more particularly to a dipole multi-band antenna usable with wireless communications.

2. Description of the Prior Art

Four standards used in Wireless Local Area Network (WLAN) include IEEE 802.11, IEEE 802.11b, and Bluetooth in the 2.4 GHz frequency band, and IEEE 802.11a in the 5 GHz frequency band. When electronic equipment must communicate in more than one frequency band, antennas must be designed which communicate in more than one band and which meet the relevant standards. A conventional antenna is disclosed in China Pat. Application No. 01,224,549 (shown in FIG. 5 of the China Application). The antenna includes a substrate, with an upper metal layer and a lower metal layer printed on two opposite surfaces of the substrate. The upper metal layer includes a signal fed microstrip and a one-quarter-wavelength radiation portion extending from one end of the microstrip. The lower metal layer includes a grounding plane and a pair of one-quarter-wavelength radiation portions extending from the grounding plane. Signals are fed into the microstrip. The three one-quarter-wavelength radiation portions work together as a dipole. This antenna can be used in mobile phones, WLANs and other wireless communication devices. However, this antenna only works in one frequency band.

China Patent Application No. 98,126,980 discloses an antenna operable in more than one frequency band. The antenna includes a substrate, an upper and a lower metal layers printed on two opposite surfaces of the substrate, two conductive strips printed on one lateral side of the substrate and connecting the upper and lower metal layers together, and a feeder device connecting to the two conductive strips and to a middle finger of the upper metal layer. The upper metal layer has two pairs of side portions formed symmetrically about the middle finger. Each pair of side portion responds to a different frequency band. However, the substrate is very thin, so the two conductive strips occupy a relatively small area, which increases the difficulty of connecting them to the feeder device. The cost of manufacture is thus increased. Additionally, the location of the two conductive strips on the lateral side of the substrate is restrictive, so the layout of the antenna lacks flexibility.

BRIEF SUMMARY OF THE INVENTION

It is an object of the present invention to provide a multi-band antenna that can be used in more than one broadband frequency band.

A multi-band antenna according to the present invention includes a first pole and a second pole connecting with the first pole. The first and second poles are both made of metal sheets. The first pole is rectangular. The second pole includes a first section, a second section and a third section, the second and third sections connecting with the first section. The first, second and third sections integrally present a fork-shaped structure and each section has a different length. A feeder device includes a coaxial cable which electrically connects with the first pole and the second pole for feeding said poles.

The invention will be described in more detail, by way of a preferred embodiment, with reference to the accompanying drawings in which:

BRIEF DESCRIPTION OF THE DRAWINGS

FIG. 11 is a table showing experimentally derived gain characteristics of the multi-band antenna in said three frequency bands.

DETAILED DESCRIPTION OF THE PREFERRED EMBODIMENT

Figure 1:
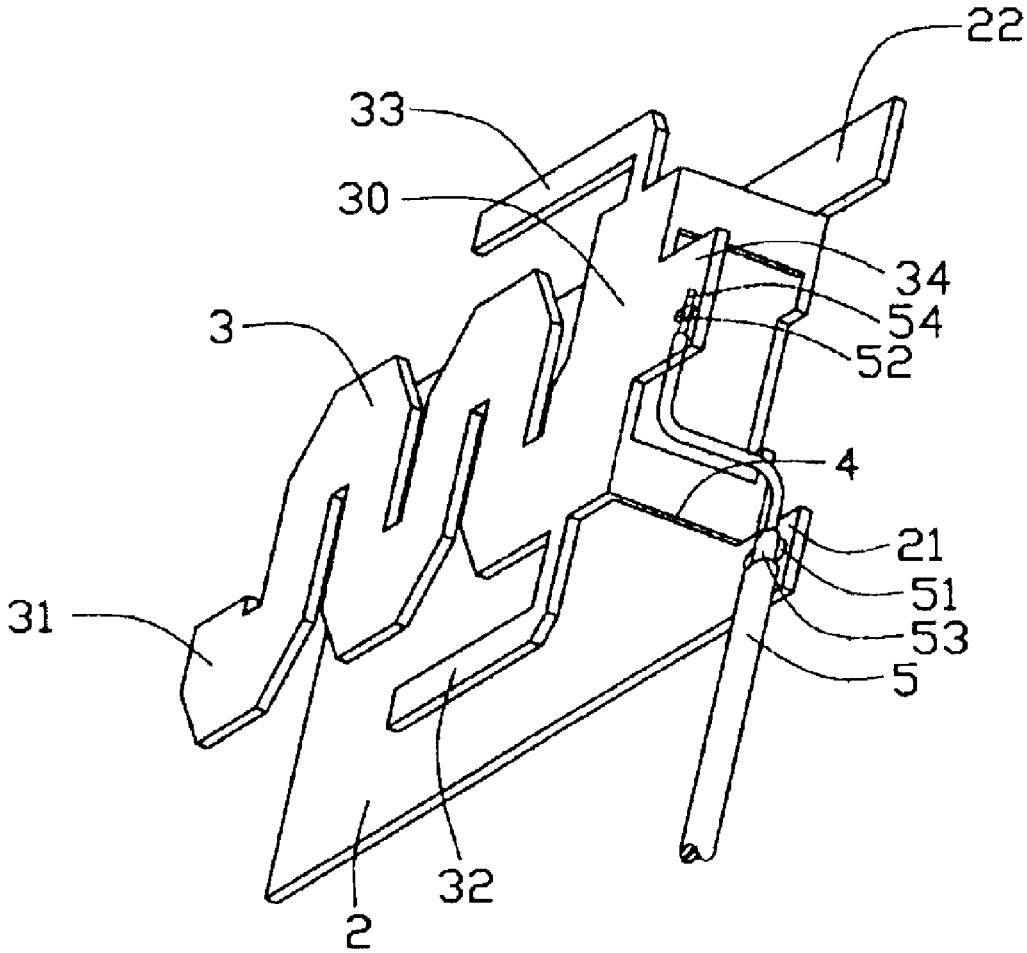
FIG. 1 is a perspective view of a multi-band antenna in accordance with a preferred embodiment of the present invention.

Referring to FIG. 1, a multi-band antenna of the present invention is a dipole antenna and includes a first pole 2, a second pole 3 and a feeder apparatus 5. The first and second poles 2, 3 are both made of metal sheets and are located on different planes. In this embodiment, the plane of the first pole 2 is parallel to the plane of the second pole 3. A connecting sheet 4 connects the first and second poles 2, 3 together. The feeder apparatus 5 is used for feeding the two poles 2, 3.

The first pole 2 is rectangular and forms a first protrusion 21 and a second protrusion 22 at a rear end portion thereof. A first feed point 51 is disposed on the first protrusion 21. Alternatively, the first feed point 51 can be disposed on the second protrusion 22. The second pole 3 includes a first section 31, a second section 32 and a third section 33. The first section 31 is serpentine in shape and forms a rectangular rear portion 30 to connect with the second and third sections 32, 33 respectively. A tab 34 extends rearwardly from the rear portion 30 and a second feed point 52 is disposed on a bottom face of the tab 34. The second section 32 and the third section 33 are L-shaped and are located on two lateral sides of the first section 31. Each of the second section 32 and the third section 33 has a different length. The first, second and third sections 31, 32, 33 integrally present a fork-shaped structure. The first pole 2 connects with the second pole 3 at a rear edge via the connecting sheet 4 and the connecting sheet 4 is perpendicular to the first and second poles 2, 3, respectively.

The feeder apparatus 5 includes a coaxial cable having a braiding 53 and a central conductor 54. The braiding 53 and the central conductor 54 connect with the first feed point 51 and the second feed point 52 respectively for inputting or outputting electrical signals.

Figure 3:
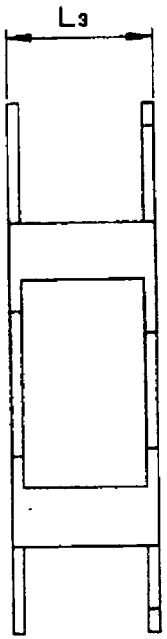
FIG. 3 is a right side view of the multi-band antenna of FIG. 1.
Figure 2:
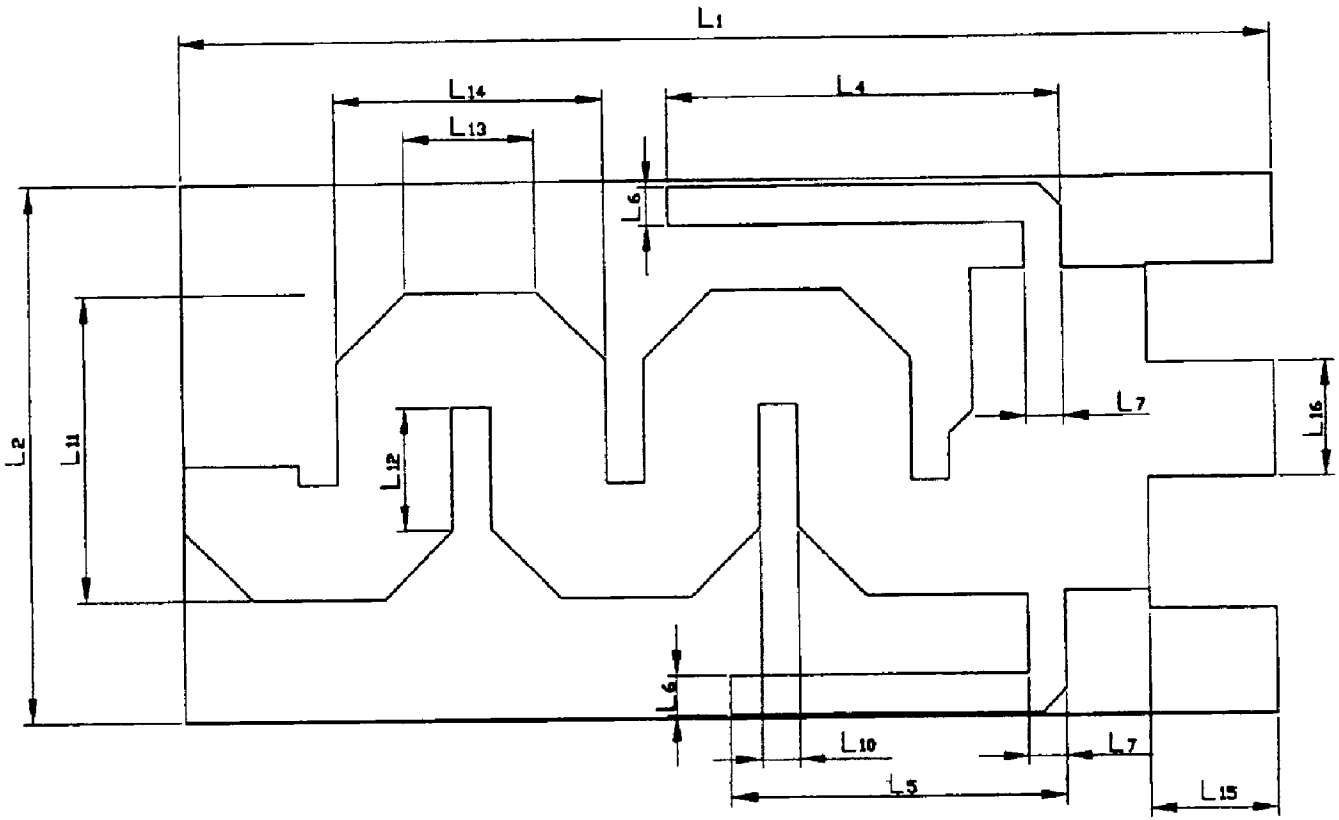
FIG. 2 is a top view of the multi-band antenna of FIG. 1.

Referring to FIGS. 2–3, in this embodiment, dimensions of elements of the antenna are taught as follows: L1=28.5 mm, L2=14.0 mm, L3=4.0 mm, L4=10.3 mm, L5=8.8 mm, L6=1.0 mm, L7=1.0 mm, L10=1.0 mm, L11=8.0 mm, L12=3.2 mm, L13=3.4 mm, L14=7.0 mm, L15=3.3 mm, L16=3.0 mm. The first, second and third sections 31, 32, 33 correspond to the frequency bands of 2.4–2.5 GHz, 5.45–5.75 GHz, and 5.15–5.35 GHz respectively, according to their lengths and widths.

Figure 4:
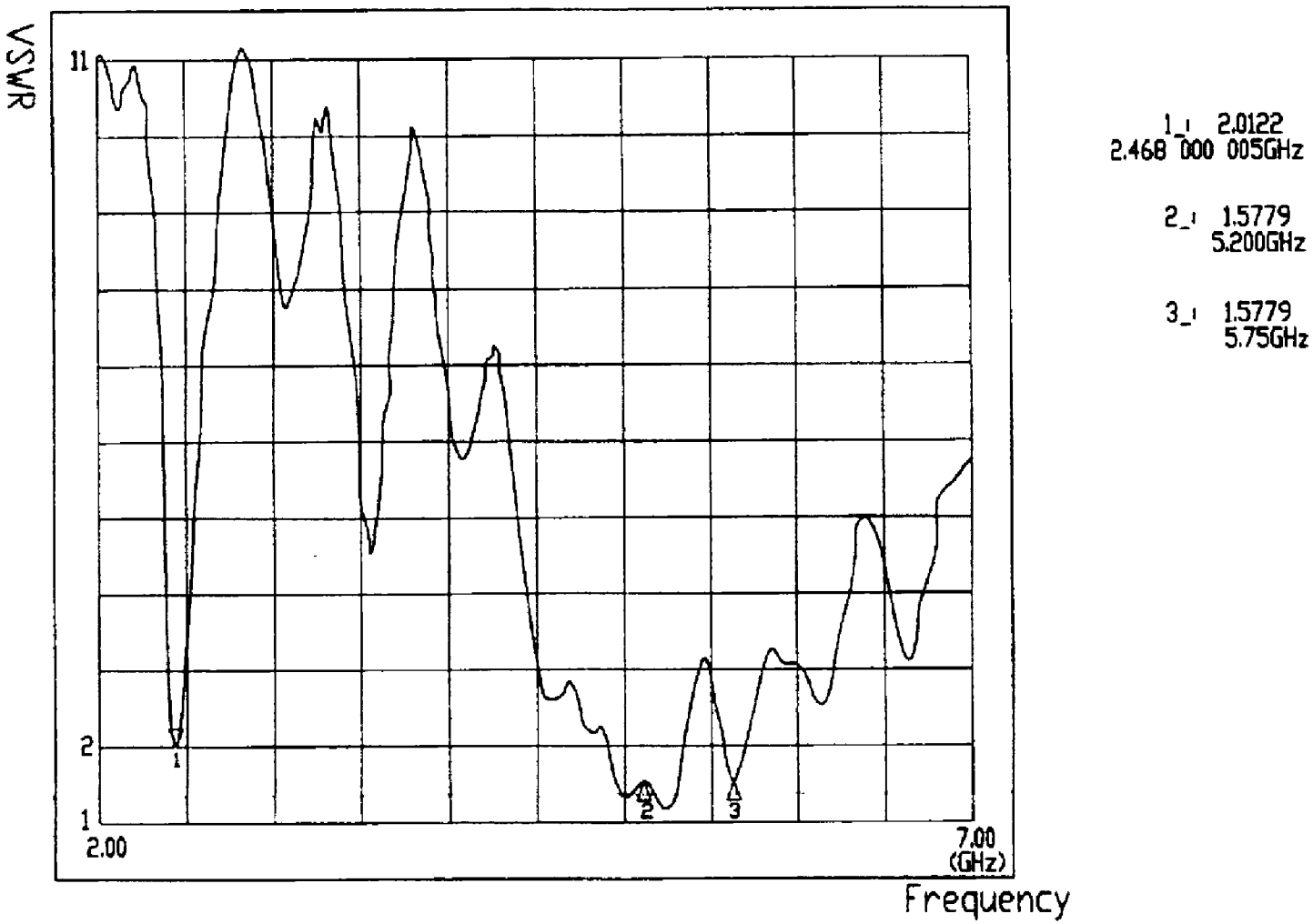
FIG. 4 is a graph showing experimental results for Voltage Standing Wave Ratio (VSWR) of the multi-band antenna of FIG. 1.
Figure 6:
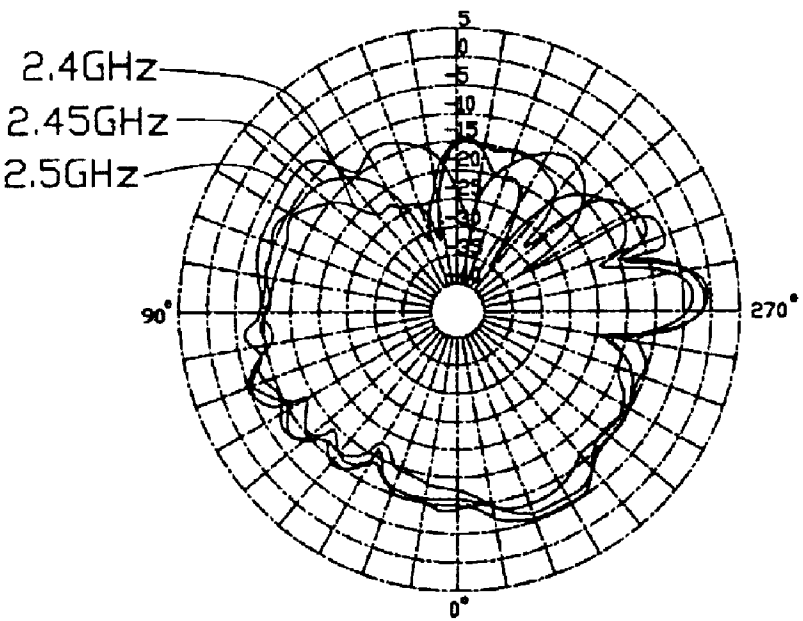
FIG. 6 is a graph showing a vertical radiation pattern of the multi-band antenna in the 2.4–2.5 GHz frequency band.
Figure 5:
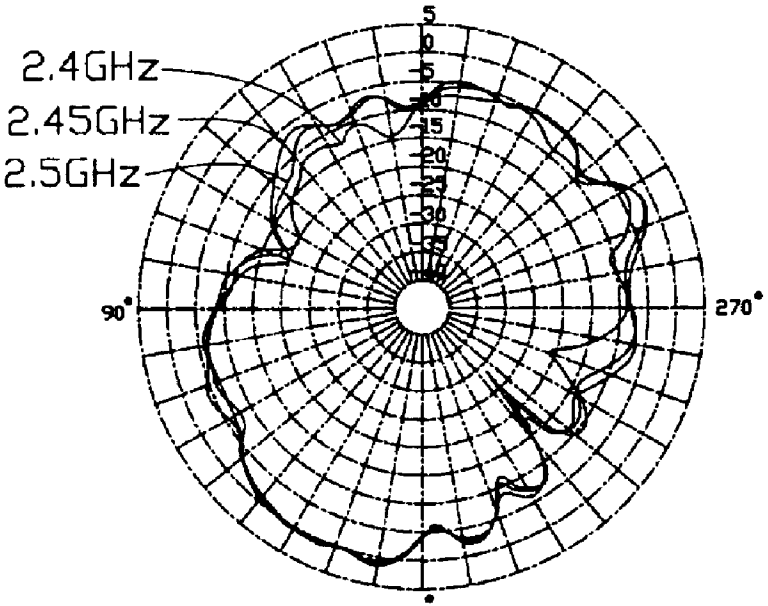
FIG. 5 is a graph showing a horizontal radiation pattern of the multi-band antenna in the 2.4–2.5 GHz frequency band.
Figure 7:
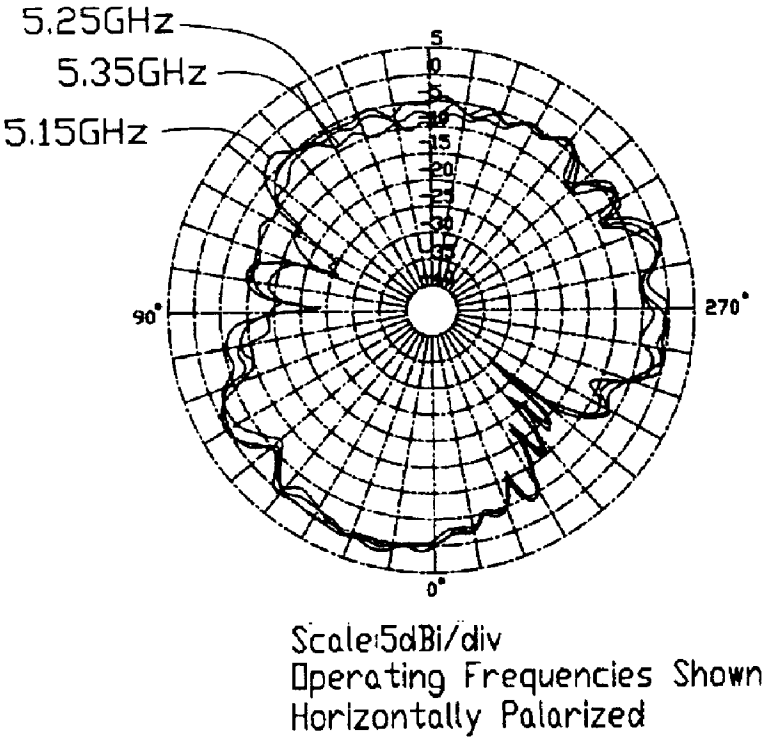
FIG. 7 is a graph showing a horizontal radiation pattern of the multi-band antenna in the 5.15–5.35 GHz frequency band.
Figure 8:
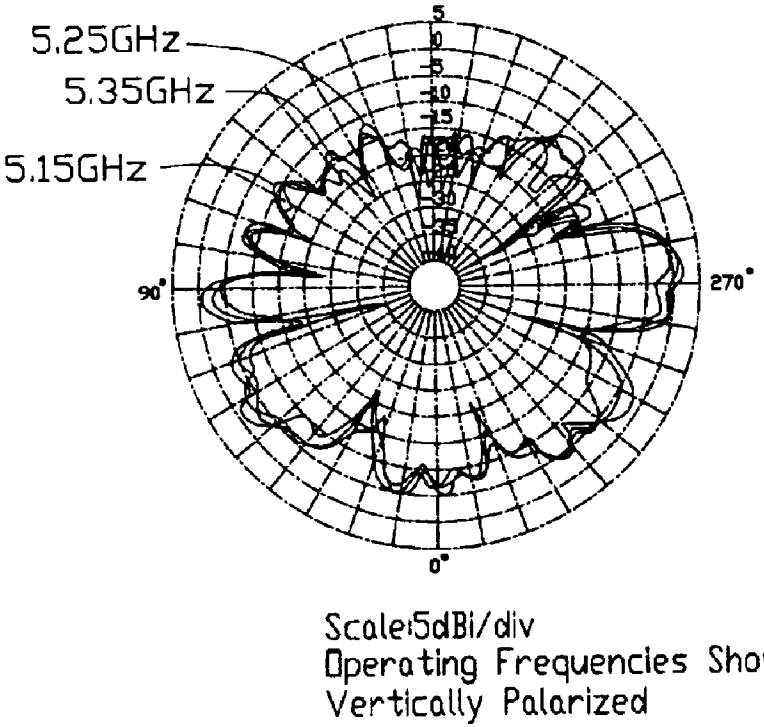
FIG. 8 is a graph showing a vertical radiation pattern of the multi-band antenna in the 5.15–5.35 GHz frequency band.
Figure 10:
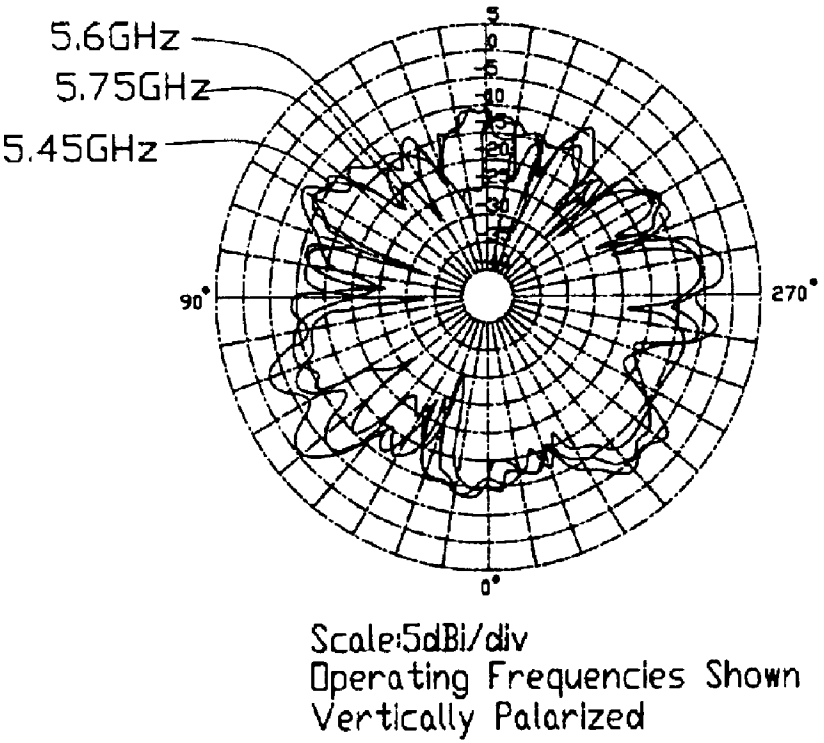
FIG. 10 is a graph showing a vertical radiation pattern of the multi-band antenna in the 5.45–5.75 GHz frequency band.
Figure 9:
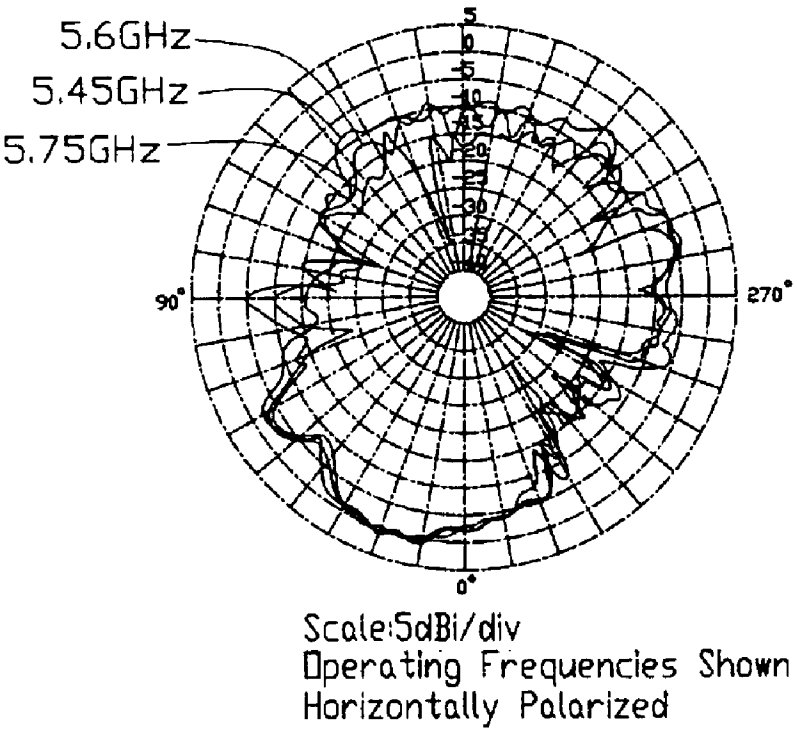
FIG. 9 is a graph showing a horizontal radiation pattern of the multi-band antenna in the 5.45–5.75 GHz frequency band.

Referring to FIG. 4, the graph of measured Voltage Standing Wave Ratio (VSWR) of the antenna as a function of frequency shows values of 2.0122, 1.5779, 1.5779, at respective frequencies of 2.468 GHz, 5.200 GHz, 5.75 GHz. Values less than 2.0 conform to design criteria for VSWR.

FIGS. 5–10 show horizontally polarized and vertically polarized radiation patterns of the multi-band antenna in the 2.4–2.5 GHz, 5.15–5.35 GHz, and 5.45–5.75 GHz frequency bands, respectively. The graphs show that the performance of the multi-band antenna generally meets requirements of antenna quality in the field.

A table of gain characteristics of the antenna in the three frequency bands shown in FIG. 11. All average gains are greater than minus five, which ensures that the multi-band antenna can be applied in practical products.

In comparison with the cited prior art antennas, the multi-band antenna of the present invention is operable in more than one frequency band since the second pole 3 is divided into three sections which present a fork-shaped structure. Each section has a different length and corresponds to a different frequency band. In addition, the multi-band antenna is made by cutting and bending a metal sheet, and it can be easily and cheaply manufactured.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. A multi-band antenna for use in a communications device comprising:

a first pole;

a second pole connecting with the first pole, the first and second poles being made of metal sheets, the second pole including a first section, a second section and a third section, said first, second and third sections integrally forming a fork-shaped structure and each section having a different length; and a feeder device including a coaxial cable which electrically connects with the first pole and the second pole for feeding said poles; and wherein the first pole is rectangular; and wherein the first pole forms a first protrusion and a second protrusion at an end portion thereof, and a first feed point is disposed on one of the two protrusions.

2. The multi-band antenna as claimed in claim 1, wherein the first section of the second pole is serpentine in shape.

3. The multi-band antenna as claimed in claim 1, wherein the first section of the second pole forms a rectangular rear portion and a tab extends rearwardly therefrom.

4. The multi-band antenna as claimed in claim 3, wherein a second feed point is disposed on the tab.

5. The multi-band antenna as claimed in claim 1, wherein the second and third sections of the second pole are both L-shaped and are located on opposite lateral sides of the first section and connect with the first section.

6. The multi-band antenna as claimed in claim 4, wherein the coaxial cable includes a braiding and a central conductor.

7. The multi-band antenna as claimed in claim 6, wherein the braiding and the central conductor connect with the first and second feed points, respectively.

8. The multi-band antenna as claimed in claim 1, wherein the first pole connects with the second pole through a conductive connecting sheet.

9. A multi-band antenna for use in a communications device comprising:

a first pole made of a metal sheet;

a second pole made of a metal sheet, including a first section, a second section and a third section, the second and the third sections connecting with the first section respectively, said first, second and third sections integrally forming a fork-shaped structure and each section having a different length;

connecting means for connecting the first pole with the second pole; and a feeder device including a coaxial cable which electrically connects with the first pole and the second pole for feeding said poles;

wherein the first pole is rectangular; and wherein the first pole forms a first protrusion and a second protrusion at an end portion thereof, and a first feed point is disposed on one of the two protrusions.

10. The multi-band antenna as claimed in claim 9, wherein the first section of the second pole is serpentine in shape.

11. The multi-band antenna as claimed in claim 9, wherein the first section of the second pole forms a rectangular rear portion and a tab extends rearwardly therefrom.

12. The multi-band antenna as claimed in claim 11, wherein a second feed point is disposed on the tab.

13. The multi-band antenna as claimed in claim 9, wherein the second and third sections of the second pole are both L-shaped and are located on two opposite lateral sides of the first section and connect with the first section.

14. The multi-band antenna as claimed in claim 12, wherein the coaxial cable includes a braiding and a central conductor.

15. The multi-band antenna as claimed in claim 14, wherein the braiding and the central conductor connect with the first and second feed points respectively.

16. A multi-band antenna comprising:

a metal sheet stamped and bent to form a generally U-shaped cross-section configuration including a first pole and a second pole in a parallel relationship with a connection section connected therebetween to space said first pole and said second pole in a distance, and a coaxial cable including a grounding conductor connected to a protrusion of the first pole and a signal conductor connected to a tab of the second pole; wherein the tab and the protrusion are located on one side of the connection section while remaining portions of said first and second poles are located on the other side of the connector section along a direction which is perpendicular to said connection section.

* * * * *